US009868301B2

(12) United States Patent
Claesson et al.

(10) Patent No.: US 9,868,301 B2
(45) Date of Patent: Jan. 16, 2018

(54) SYSTEM FOR A PRINTER, A PRINTER AND A PRINT SUBSTRATE EDGE GUIDE

(71) Applicant: HEWLETT-PACKARD DEVELOPMENT COMPANY, L.P., Houston, TX (US)

(72) Inventors: Jerry Claesson, Barcelona (ES); Francesc Melia, Sant Cugat del Valles (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/113,159

(22) PCT Filed: Jan. 30, 2014

(86) PCT No.: PCT/EP2014/051810
§ 371 (c)(1),
(2) Date: Oct. 14, 2016

(87) PCT Pub. No.: WO2015/113605
PCT Pub. Date: Aug. 6, 2015

(65) Prior Publication Data

US 2017/0136786 A1 May 18, 2017

(51) Int. Cl.
*B41J 11/00* (2006.01)
*B41J 11/06* (2006.01)

(52) U.S. Cl.
CPC ..... *B41J 11/0045* (2013.01); *B41J 11/06* (2013.01)

(58) Field of Classification Search
None
See application file for complete search history.

(56) References Cited

U.S. PATENT DOCUMENTS

| | | | |
|---|---|---|---|
| 5,838,338 | A | 11/1998 | Olson |
| 6,000,786 | A | 12/1999 | Larson |
| 6,361,230 | B1 | 3/2002 | Crystal et al. |
| 6,594,027 | B1 | 7/2003 | Guillemin et al. |
| 6,857,803 | B2 | 2/2005 | Smith |
| 7,591,533 | B2 | 9/2009 | Silverbrook |
| 7,695,204 | B2 | 4/2010 | Silverbrook |
| 9,145,002 | B2 | 9/2015 | Chover Lopez et al. |

(Continued)

FOREIGN PATENT DOCUMENTS

| | | | |
|---|---|---|---|
| CN | 101171136 | A | 4/2008 |
| EP | 1371490 | A1 | 12/2003 |

(Continued)

OTHER PUBLICATIONS

European Patent Office. International Search Report, dated Oct. 1, 2014, Application No. PCT/EP2014/051810. Filing date Jan. 30, 2014.

(Continued)

*Primary Examiner* — Lisa M Solomon
(74) *Attorney, Agent, or Firm* — HP Inc. Patent Department

(57) ABSTRACT

An example system for a printer in accordance with the present disclosure is provided. The system comprises a replaceable platen assembly including a group of interchangeable platens, each platen to support a different type of print substrate, and an edge guide associated with the platen assembly, the edge guide for guiding an edge of a print substrate.

20 Claims, 4 Drawing Sheets

(56) References Cited

U.S. PATENT DOCUMENTS

| | | | |
|---|---|---|---|
| 2002/0168206 | A1 | 11/2002 | Smith |
| 2009/0284575 | A1 | 11/2009 | Verhoest |
| 2013/0136521 | A1 | 5/2013 | Garcia et al. |

FOREIGN PATENT DOCUMENTS

| | | | | |
|---|---|---|---|---|
| JP | 9105208 | | 4/1997 | |
| WO | WO2006/026839 | A2 | 3/2006 | |
| WO | WO 2006026839 | A2 * | 3/2006 | ..... B41J 3/4078 |

OTHER PUBLICATIONS

HP DesignJet L25500 Printer Series—Printer Technologies, Dec. 2013.

* cited by examiner

SYSTEM FOR A PRINTER, A PRINTER AND A PRINT SUBSTRATE EDGE GUIDE

BACKGROUND

Many wide format printers utilize an elongated platen to support the print substrate through the print zone. It often is desirable to use different platen configurations specially configured to support a variety of different types of print substrates. For example, in an inkjet printer, a smooth hard vacuum platen may be desirable for printing on paper and vinyl substrates while a platen that includes an ink absorber may be desirable for printing on textiles and other porous substrates. Large format printers, for example, may print on paper, vinyl and textiles in varying width supplied as roles of flexible web.

DRAWINGS

DESCRIPTION

A system has been developed to increase the versatility of printers for printing on different types of substrates. Inkjet printers using latex inks are capable of printing on a variety of very different substrates including, for example, paper, textiles, and vinyl. These types of print substrates each have unique characteristics. Accordingly, it is often desirable to specially configure the platen to a particular type of print substrate to better support or control the substrate through the print zone. Specially configured platens are particularly desirable for wide format printers, which may handle print substrates as wide as several meters. Currently, however, it is difficult to use the same wide format printer to print on disparate substrates, like paper, textiles and vinyl for example, because significant modifications may be made to the printer platen to achieve consistently good print quality.

The system includes interchangeable platens to support different types of print substrates. For example, a platen system for a wide format latex inkjet printer might include a group of three interchangeable platens specially configured for paper, textile and vinyl so that the printer can be readily adapted for printing on any of these three types of print substrate by replacing one platen assembly with another platen assembly. A special type of platen for use with porous substrates, e.g. textiles, which can collect and/or absorb ink or another printing fluid penetrating through the substrate, is also designated "a gutter" or a "gutter-type" platen in the context of this patent application. Also, in one example implementation, each platen in the group can consist of multiple modules to more easily vary the width of the platen assembly to accommodate different size print substrates and/or different size printers by simply using more or fewer modules. The system further includes an edge guide associated with the platen assembly for guiding an edge of the print substrate so that the print substrate is kept flat as the substrate passes through the print zone during printing. In one example, the edge guide is fixed to the platen assembly such that it can be inserted into the printer and removed from the printer together with the platen assembly.

Examples of the system are described below with reference to a wide format inkjet printer, such as a scanning printhead type printer or a page-wide array printer. The system, however, is not limited to such inkjet printers or even to inkjet printing, but may be implemented in other printers. Accordingly, the examples shown in the figures and described below illustrate but do not limit the invention, which is defined in the Claims following this Description.

Figure 1:
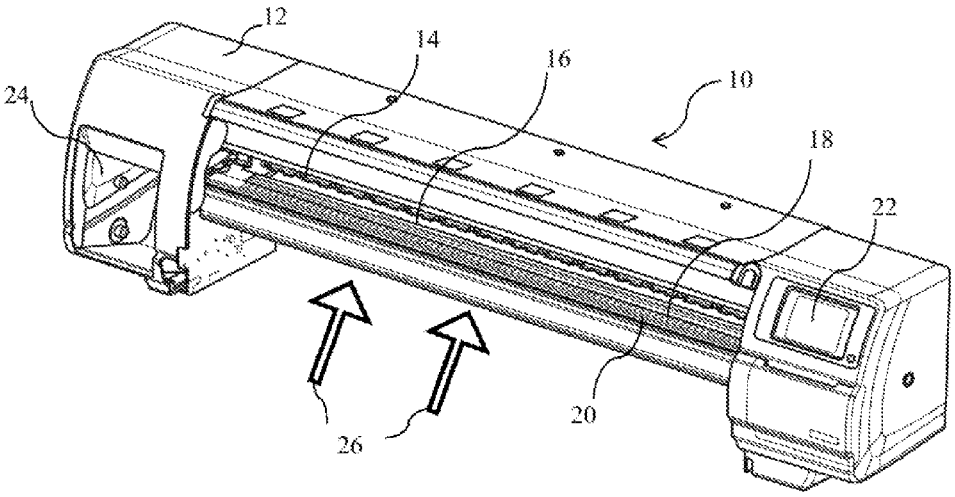
FIG. 1 illustrates an inkjet printer implementing one example of an edge guide system for holding down the edges of print substrates.

FIG. 1 illustrates an isometric view of a wide format inkjet printer implementing one example of the new system for supporting and guiding different types of print substrates. The printer 10 comprises a housing generally shown at 12, defining a feed opening 14 for passing a print substrate therethrough. A print zone 16 is visible in the feed opening, the print zone 16 comprising a first platen assembly 18 and a second platen assembly 20. The first platen assembly 18 can be a fixed platen and the second platen assembly 20 can be an interchangeable or replaceable platen assembly for accommodating different types of print media.

Figure 2:
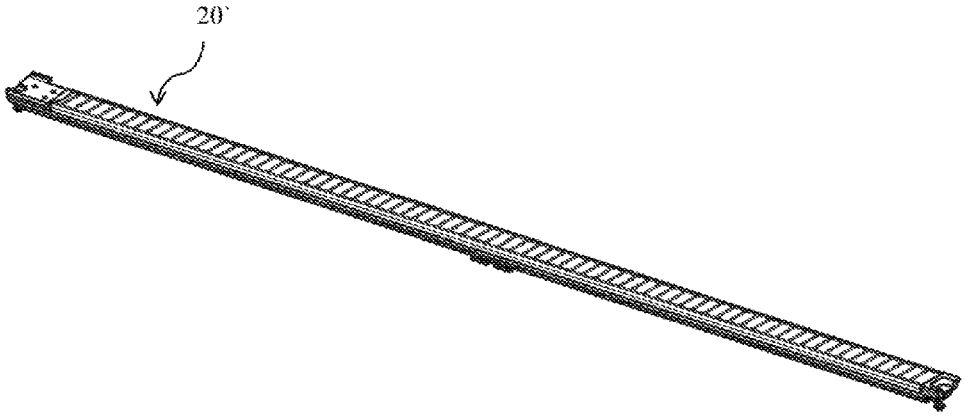
FIGS. 2 and 3 show examples of components of a replaceable platen assembly for a printer system including different types of platens.
Figure 3:
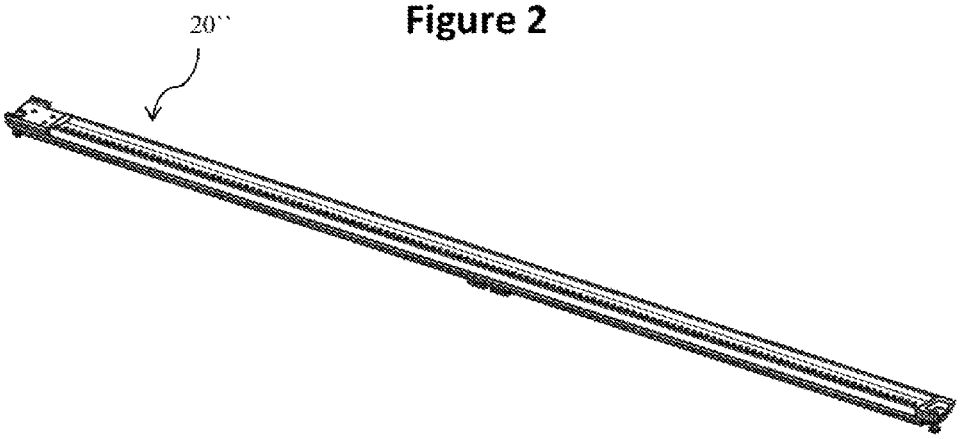

FIGS. 2 and 3 illustrate different types of interchangeable platen modules. 2 shows an example of an interchangeable platen module 20' having a relatively smooth and hard surface configured to support a paper or plastic print substrate, and FIG. 3 shows a second type of an interchangeable platen module 20" configured to support a porous print substrate, such as a woven or non-woven textile or foam. The second type of platen module 20' can be a gutter for collecting and absorbing residue ink penetrating through the print substrate. The interchangeable platen module 20' may comprise a collecting zone and/or absorbing foam. The gutter-type platen 20" can have a grid like surface for carrying the print substrate, said surface preventing that the substrate and edge holder come into contact with excess ink collected in the gutter and be soiled.

The printer illustrated in FIG. 1 further comprises an operating display 22 and a slot 24 for receiving ink cartridges.

While not shown in detail in the drawings, the printer 10 also includes a group of multiple printheads, for example to dispense different color inks, mounted on a carriage over the print zone 16. A substrate transport in the printer 10 includes a web supply roller and a web take-up roller. A web print substrate extends from supply roller over the print zone 16 and intermediate rollers to take-up roller. Intermediate rollers may be used, for example, to help control the direction and tension of web through a print zone 16 over platens 18, 20. Printheads dispense ink as they are scanned back and forth on carriage across substrate as it passes over platen 20 through print zone 16. An air pump or other suitable vacuum source can be operatively coupled to platens 18 and/or 20 through a system of air passages (not shown) and controls (not shown) may be used to exert a hold-down force on print substrate as necessary or desirable for some printing operations.

In the example shown, the print zone 16 includes the first, fixed platen assembly 18 and the second, replaceable platen assembly 20. As used in this document, "fixed" means not easily removed and "replaceable" or "interchangeable" means easily installed and removed. The replaceable platen assembly 20 in FIG. 1 represents multiple interchangeable platens each easily installed into and removed from the printer 10, for example using quick release fasteners. The fixed platen assembly 18, by contrast, is a fixed part of the printer 10. Thus, while it may be possible to remove the fixed platen assembly 18 fur maintenance, repair or replacement, the platen assembly 18 represents generally a fixed part of the printer 10 that is not designed to be removed or replaced regularly like the replaceable platen assembly 20. Also, in the example shown, the replaceable platen assembly 20 is positioned directly under printheads and the fixed platen assembly 18 is positioned downstream from the replaceable platen assembly 20. The use of a fixed platen assembly 18 may help minimize the area needed for, and thus the size of, replaceable platen assembly 20. With the fixed platen assembly 18, replaceable platen assembly 20 may be constrained more closely to the area directly under printheads where ink is dispensed on to substrate. If the fixed platen assembly 18 is used, it may be positioned downstream from the replaceable platen assembly 20, as shown or at other suitable locations upstream from the platen assembly 20 or on both sides of the platen assembly 20.

"Upstream" and "downstream" refer to the direction substrate moves through the print zone 16. The direction print substrate moves through the print zone 16 is indicated by arrows 26 in FIG. 1. "Length" is the direction the substrate moves through print zone. "Width" is perpendicular to the direction the substrate moves through the print zone 16. Thus, in the examples shown in the figures, the platen assembly 20 is much wider than it is long.

Referring now also to the more detailed views of FIGS. 2 and 3, the system of this example includes a group of at least two interchangeable platens 20', 20", for example a rigid vacuum platen 20', for example to support paper and other cockle prone print substrates, or a flat vacuum platen 20', for example to support vinyl print substrates (shown individually in FIG. 2); and an absorbent platen or gutter-type platen 20", for example to support textiles and other porous print substrates (shown individually in FIG. 3). The group of interchangeable platens 20', 20" shown in FIGS. 2 and 3 are just one example group of interchangeable platens for the platen system. The systems of this disclosure might include more interchangeable platens, and/or differently configured interchangeable platens than those shown. Each platen may be composed of a number of platen modules.

Figure 4:
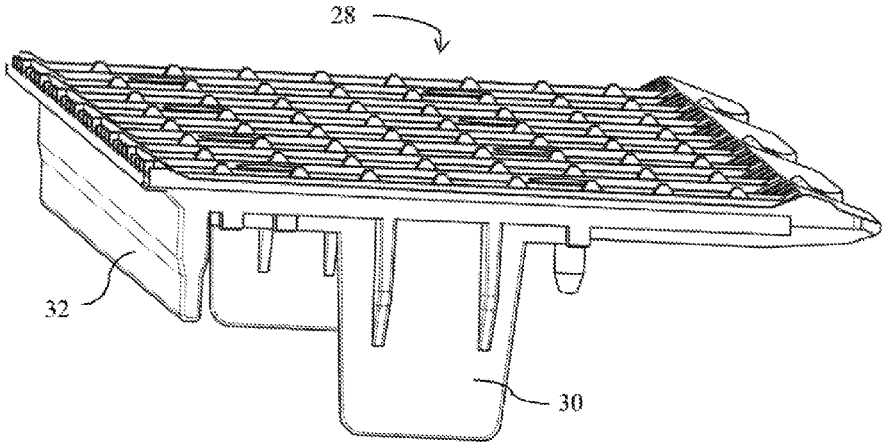
FIG. 4 shows a more detailed enlarged view of an example of a platen module of the replaceable platen assembly.

FIG. 4 shows an isometric view of a replaceable platen module in greater detail. At least one replaceable platen module 28 can form part of the platen 20 wherein a number of such modules can be fitted side to side to vary the width of the platen to accommodate different size print substrates and/or different size printers compared to one-piece platens. The width of the overall platen may be expanded or contracted simply by using more or fewer modules 28. The platen module 28 can be fixed to the printer via flanges 30 and additionally can be mounted to a printer structure using quick release fasteners or other fastening means, as described in co-pending U.S. patent application Ser. No. 13/718,747, filed on Dec. 18, 2012, and entitled "Interchangeable printer platen". The disclosure of this document, and in particular the description of the interchangeable platens disclosed therein, is incorporated in its entirety by reference.

The platen module 28 comprises a guide rail 32 for slidably fixing an edge guide, as described further below. In other examples guide rail or another guide structure may be provided elsewhere on the replaceable platen assembly.

Figure 5:
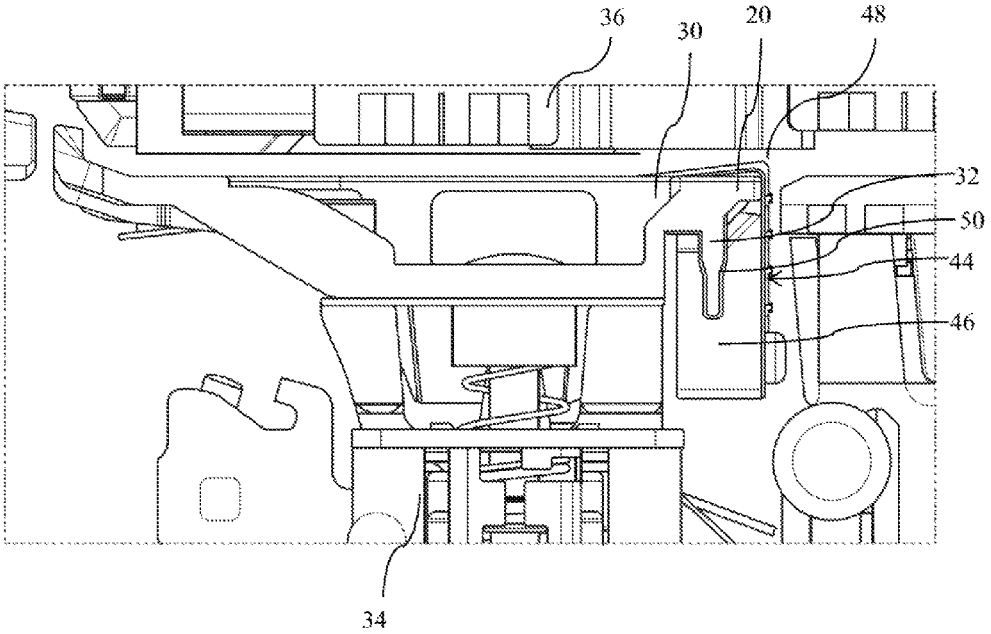
FIG. 5 shows cut through a part of an inkjet printer including a replaceable platen assembly and an edge holder according to one example.

FIG. 5 illustrates a sectional view of part of a printer according to one example. FIG. 5 shows the replaceable platen assembly 20 including a guide rail 32, similar to the one shown in FIG. 4. The platen assembly 20 is fixed to a printer structure 34 via the flange 30 of the platen assembly 20 wherein this fixture can be released easily. Optional fastening means, such as quick-release fasteners, can be used. The structure 34 is a fixed part of the printer and maybe fixed to or integral with fixed platen 18. Vacuum air passages (not shown) in the structure 34 and platens allow to apply a vacuum to print substrate as necessary or desirable to help control the print substrate moving across the platen assembly. The replaceable platen assembly 20 may include corresponding vacuum passages (not shown) for applying a vacuum to the substrate and/or extract aerosol released from the ink or other printing fluid. In the example shown in FIG. 5, strictly speaking, it is not just a platen or a platen module, as shown in FIG. 4 which may be replaced but rather the platen assembly 20, including possibly several platen modules 28, guide rail 32 and edge guide assembly (described below) together form a "removable print zone" which can be removed and interchanged whereas the remaining parts, such as structure 34, remain in the printer.

Figure 6:
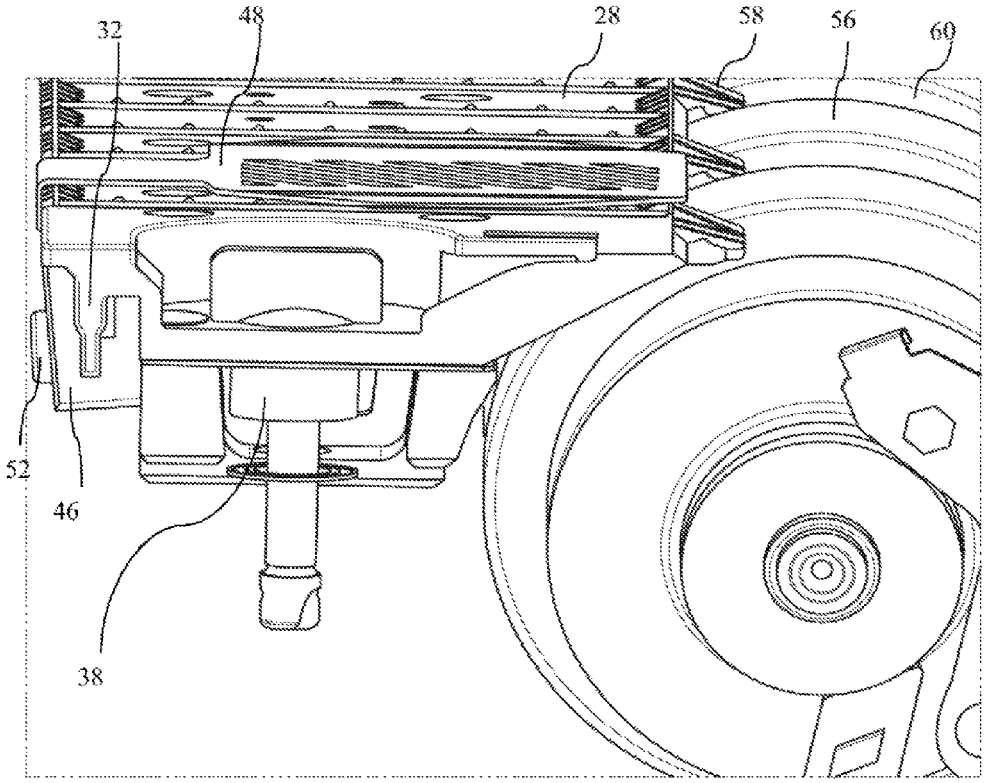
FIG. 6 shows an isometric view of part of an inkjet printer including a replaceable platen assembly and an edge holder according to one example.
Figure 7:
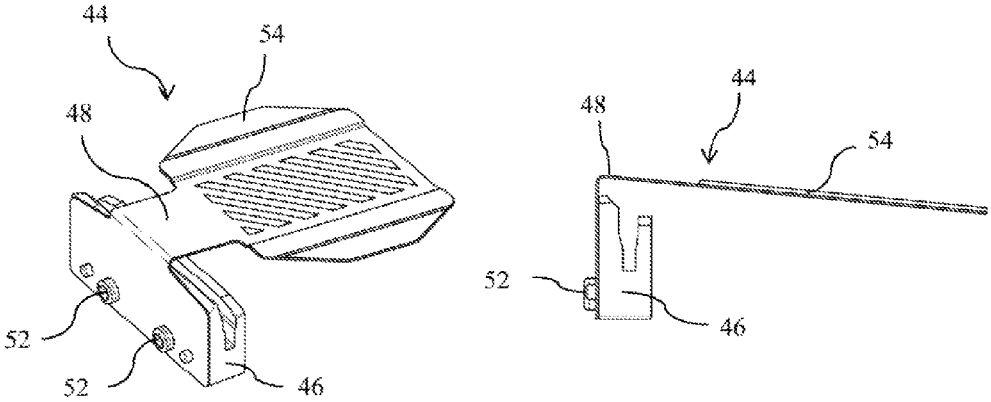
FIG. 7 illustrates an isometric view and a side view of an edge holder according to one example.

FIG. 5 further shows an edge guide assembly 44 associated with the guide rail 32 for guiding an edge of the print substrate, holding down the substrate on the platen assembly 20 so as to keep the substrate flat against the platen as the substrate passes through the print zone during printing. The edge guide assembly 44 comprises an engagement component 46 for engagement with the guide rail 32 and a holding component 48 connected to or integrated with the engagement component 46 for holding down the substrate. The engagement component 46 includes a groove 50 for engagement with the guide rail 32 so that the edge guide assembly 44 can slide along guide rail 32. Additionally, means for fixing the edge guide assembly 44 at a position along guide rail 32 can be provided. The holding component 48, in the example shown in FIGS. 5 to 7, is a part separate from the engagement component 46 and is fixed thereto by screws 52 (see FIG. 7), for example. In the illustrated example, the engagement component 46 may be formed by injection molding from a plastic material so as to be relatively rigid; and the holding component 48 may be formed from a sheet metal, providing a resilient force for clamping a substrate between the platen assembly 20 and a flexible holding tongue 54.

As shown in FIGS. 5 to 7, the edge guide assembly 44 is fixed to the platen assembly 20 along only one (trailing) edge thereof (in the direction of print substrate movement) and extends across the whole or substantially the whole length of the platen assembly 20 from said side (see FIG. 6). This configuration of the replaceable platen assembly 20, with the edge guide assembly 44 fixed to the trailing edge thereof, allows to use a printer configuration using the drive roller 56 for print substrate transport which extends along only the (leading) edge of the platen assembly 20, opposite to the guide rail 32. More particularly, it allows using a drive roller 56 in which the roller is not continuous and fingers 58 extend into grooves 60 provided in the drive roller 56 so as to ensure a smooth transition of the print substrate from the drive roller to the platen assembly 20 and vice versa (see FIG. 6).

Of course, This disclosure is not limited to the exact configuration of the edge guide assembly 44 shown therein. In various examples, the engagement component and holding component may be made from different materials, may be made from more than two parts, or may be integrally formed. It is also possible to provide a fixture between the edge guide assembly and the platen assembly so that the edge guide is fixed at both longitudinal sides of the platen assembly 20. If the printer is dedicated for only substrates of identical widths, the edge guide assembly also need not be slidable along the width of the platen assembly 20 or even could be fixed at the short traverse side edges of the platen assembly. Also the platen/drive roller configuration can vary where it is not necessary to have the fingers 58 shown in FIG. 6, but it also would be possible to provide an entry (or exit) drive roller e.g. below the platen where the print substrate is pulled across the print zone.

As described above, the replaceable platen assembly 20 may comprise a platen or platen modules having a relatively hard rigid surface or a gutter-type platen or platen modules, with or without an additional absorbent material. The gutter-type platen can be configured such that the holding component 48 may not touch any stained surfaces or foams for collecting and/or absorbing ink which penetrates through an absorbent print substrate. This can be achieved, for example, by providing the gutter-type platen with a grid-like surface.

The edge guide assembly 44 is fixed to the replaceable platen assembly 20 in such a way that it is easily inserted into the printer and removed from the printer together with the replaceable platen assembly. It is possible to provide a printer with a set of several interchangeable platens or platen modules which are provided with dedicated edge guide assemblies 44, wherein the configuration of each of the edge guides can be identical between different platens. This allows easily inserting and removing the platen assembly and also allows easily replacing and exchanging edge guide assemblies between different platen assemblies.

Figure 8:
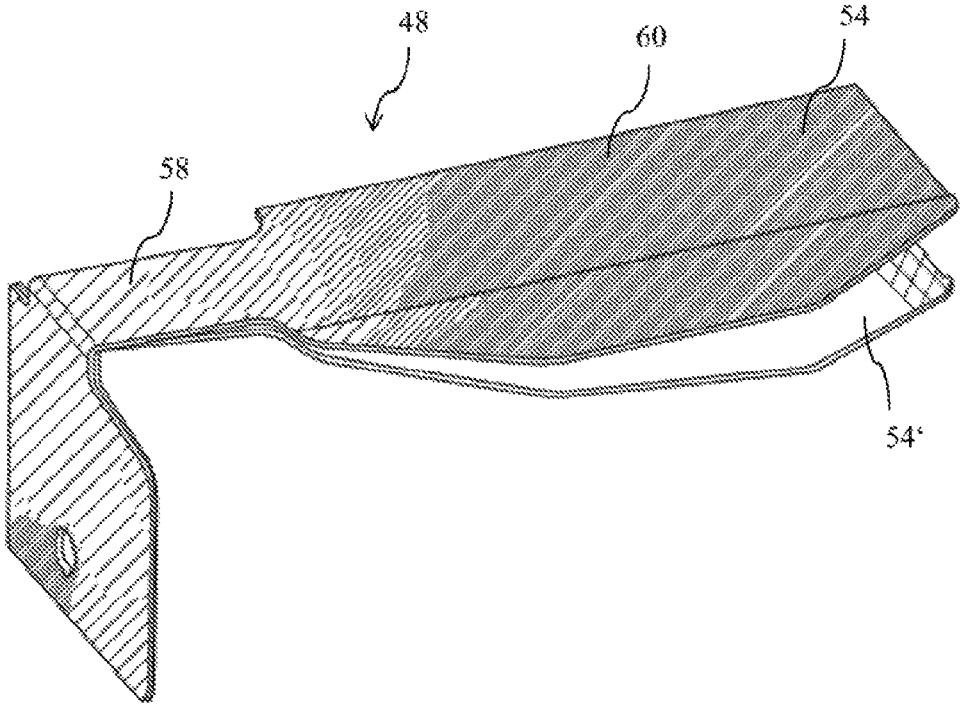
FIG. 8 shows an isometric view of part of the example of FIG. 7 and illustrates bending forces applied to the edge holder.

FIG. 8 illustrates an example of the holding component 48 having zones of different rigidity wherein a zone of higher rigidity 60 is illustrated by densely spaced hatching and a zone of lower rigidity 58 is illustrated by more loosely spaced hatching. The less rigid zone 58 allows flexing of the holding component 48 and the more rigid zone 60 ensures that the tongue of the holding component remains relatively flat to hold down side edges of the print substrate. The cross hatched illustration 54' of the holding tongue 54 represents the tongue in a relaxed state whereas the hatched illustration 54 represents the tongue in a slightly deflected state for clamping a print substrate.

The examples shown in the figures and described above illustrate but do not limit the disclosure. Other examples are possible.

The invention claimed is:

1. A system for a printer comprising a removable platen assembly; and an edge guide associated with the platen assembly, the edge guide for guiding an edge of a print substrate.

2. The system of claim 1 wherein the edge guide is fixed to the platen assembly such that the edge guide is inserted into the printer and removed from the printer together with the platen assembly.

3. The system of claim 1 wherein the removable platen assembly comprises a plurality of platen modules.

4. The system of claim 1 wherein the system includes a group of interchangeable platens each supporting a different type of print substrate, and a first edge guide is associated with a first one of the interchangeable platens and a second edge guide is associated with a second one of the interchangeable platens.

5. The system of claim 4 wherein the first edge guide and the second edge guide have an identical fixture arrangement for fixing the first and second edge guides to the platen assembly.

6. The system of claim 1 wherein the system includes a group of interchangeable platens each configured to support a different type of print substrate, and one edge guide is selectively associated with a first one of the interchangeable platens and a second edge guide is associated with a second one of the interchangeable platens.

7. The system of claim 1 wherein the platen assembly comprises a guide component along at least part of one longitudinal side thereof, and the edge guide comprises an engagement component for engagement with the guide component and wherein the edge guide is slidable along at least part of the length of the platen assembly.

8. The system of claim 7 wherein the edge guide extends from said longitudinal side across the platen assembly in a width direction thereof and is not fixed at an opposite longitudinal side of the platen assembly.

9. The system of claim 1 wherein the platen assembly comprises a guide rail along at least part of one longitudinal side thereof, the guide rail extending from a bottom side of the platen assembly, and the edge guide comprises an engagement recess for engagement with the guide rail, the edge guide being slidable along at least part of the length of the platen assembly.

10. The system of claim 1 wherein the edge guide is additionally fixed to the platen assembly by at least one bolt.

11. An edge guide for holding a print substrate on a removable print substrate support, the print substrate movable over the print substrate support through a print zone, the edge guide comprising an engagement component for engagement with a corresponding guide component at one longitudinal side of the print substrate support, wherein the edge guide is slidable relative to the print substrate support, along a length of the guide component; and wherein the edge guide is supported on said one longitudinal side of the print substrate support and extends from said longitudinal side across the print substrate support in a width direction thereof; and wherein the edge guide remains mounted to the removable print substrate support when the print substrate support is removed from the printer.

12. The edge guide of claim 11 wherein the edge guide comprises a holder component connected to or integrated with the engagement component, wherein the edge guide is supported on said one longitudinal side of the print substrate support so that the holder component is spaced parallel to and from a surface of the print substrate support.

13. The edge guide of 12 wherein the engagement component is a molded plastic part having a groove for engagement with a corresponding guide rail provided at a bottom side of the print substrate support; and the holder component is a metal or plastic part having a relatively flexible section connected to the engagement component and an relatively rigid section extending across the surface of the print substrate support.

14. A printer comprising a printhead to dispense printing fluid on to a print substrate in a print zone;

a removable platen assembly to support the print substrate in the print zone;

a substrate transport to move the print substrate through the print zone over the removable platen assembly; and an edge guide arranged at a longitudinal side of the removable platen assembly holding down the edges of the print substrate as it moves over the platen assembly through the print zone.

15. The printer of claim 14 wherein the edge guide extends from a first longitudinal side of the removable platen assembly across the removable platen assembly in a width direction thereof and is fixed to the platen assembly only at said first longitudinal side of the platen assembly; and the edge guide is slidable along the longitudinal side of the removable platen assembly in a length direction thereof.

16. The system of claim 1 wherein the system comprises a group of at east two interchangeable platens each supporting a different type of print substrate.

17. The system of claim 1 wherein the edge guide comprises a holding component comprising zones of different rigidity.

18. The system of claim 1 further comprising quick release fasteners for removably securing the removable patent assembly in the printer.

19. The system of claim 1 further comprising fingers of the removable platen assembly that extend into grooves in a drive roller to provide a transition for the print substrate between the driver roller and removable platen assembly.

20. The printer of claim 14 further comprising a second, fixed platen to cooperate with the removable platen assembly to support the print substrate.

* * * * *